United States Patent [19]

Kehlenbach

[11] Patent Number: 4,718,813

[45] Date of Patent: Jan. 12, 1988

[54] TRANSPORT CART

[75] Inventor: Guenther Kehlenbach, Wuerselen, Fed. Rep. of Germany

[73] Assignee: H. Krantz GmbH & Co., Aachen, Fed. Rep. of Germany

[21] Appl. No.: 852,538

[22] Filed: Apr. 16, 1986

[30] Foreign Application Priority Data

Apr. 17, 1985 [DE] Fed. Rep. of Germany ..... 3513728

[51] Int. Cl.[4] ..... B62B 3/00

[52] U.S. Cl. ..... 414/684; 414/469; 414/783; 414/908; 414/910; 414/911

[58] Field of Search ..... 414/684, 910, 911, 24.5, 414/349, 350, 469, 783, 428, 426, 908; 298/2, 10; 269/59, 71; 242/79

[56] References Cited

U.S. PATENT DOCUMENTS

| | | | |
|---|---|---|---|
| 764,344 | 7/1904 | Buckelew | 414/684 X |
| 2,198,644 | 4/1940 | Wettengel | 414/684 X |
| 2,238,633 | 4/1941 | Drum et al. | 414/684 X |
| 2,696,920 | 12/1954 | Anjeskey | 414/908 X |
| 2,706,056 | 4/1955 | Talley et al. | 414/908 X |
| 2,799,415 | 7/1957 | Dean, Jr. | 414/684 X |
| 3,191,786 | 6/1965 | Langrell | 414/684 X |
| 3,279,753 | 10/1966 | Ventriglio et al. | 414/684 X |
| 3,687,300 | 8/1972 | Andersson | 414/783 |
| 3,735,886 | 5/1973 | Stumpf | 414/911 X |
| 3,977,662 | 8/1976 | Cook | 269/71 X |
| 3,995,758 | 12/1976 | Kovaleski | 414/426 |
| 4,322,198 | 3/1982 | Zuber | 414/684 X |
| 4,430,040 | 2/1984 | Halmos | 414/783 |
| 4,451,198 | 5/1984 | Sanderson | 414/911 X |
| 4,593,883 | 6/1986 | Nelson | 414/911 X |

FOREIGN PATENT DOCUMENTS

| | | | |
|---|---|---|---|
| 1185122 | 1/1965 | Fed. Rep. of Germany | 414/684 |
| 2069451 | 8/1981 | United Kingdom | 414/911 |

*Primary Examiner*—Leslie J. Paperner
*Assistant Examiner*—P. McCoy Smith
*Attorney, Agent, or Firm*—W. G. Fasse; D. H. Kane, Jr.

[57] ABSTRACT

A transport cart for material carriers such as bobbins or drums having threads or other elongated material wound thereon, has a cart frame with wheels and a tilting frame journalled in said cart frame. The tilting frame carries two parallel skids for supporting a material carrier on its rollers. The tilting frame is tiltable between a first position in which the skids extend horizontally for loading a material carrier onto the cart, and a second position in which the skids extend vertically for unloading a material carrier, or vice versa.

9 Claims, 3 Drawing Figures

TRANSPORT CART

FIELD OF THE INVENTION

The invention relates to a transport cart, particularly for a material carrier which carries one or more bobbins or drums on which elongated material is wound, for example, textile materials such as threads wound on bobbins or spools.

DESCRIPTION OF THE PRIOR ART

Conventional transport carts for such material carriers comprise a wheeled cart frame supporting two parallel skids on which a material carrier equipped with rollers may be shifted back and forth. It is customary to move a material carrier which has been transported by such a transport cart entirely along the skids into a dyeing chamber while the material carrier is loaded with winding members having wound thereon textile material. For this purpose the dyeing chamber which has a longitudinal axis extending horizontally, is equipped with a lateral door for the entry of the material carrier. However, it is necessary, for example, for a preliminary dewatering of the textile material wound on the winding members, to remove these winding members either in groups or individually from the material carrier in order to place these winding members into a drum constructed for rotation about a vertical axis. Prior art transport carts are not convenient for this purpose of moving a carrier between horizontal and vertical stations.

OBJECTS OF THE INVENTION

In view of the foregoing it is the aim of the invention to achieve the following objects singly or in combination:

to construct a versatile transport cart especially for a material carrier loaded with wound up textile material in such a manner that the loaded material carrier can be easily tilted from a position in which its longitudinal axis extends substantially horizontally into another position in which its longitudinal axis extends at an angle to the horizontal or substantially vertically;

to adapt such a transport cart for picking up a loaded material carrier from a position in which it is substantially horizontally oriented and delivering the carrier into a position in which its longitudinal axis is substantially vertically oriented so that an individual handling or manipulation of the textile carrying bobbins or groups of such bobbins between different treatment processes is avoided;

to provide means for locking the material carrier in its position on the cart against movement along its skid rails; and to provide locking means for locking the skid rails in a substantially horizontal position and for latching the skid rails in a substantially vertical position on the cart.

SUMMARY OF THE INVENTION

The transport cart according to the invention is characterized in that the skids for the material carrier are mounted in a tilting frame which in turn is journalled in the cart frame. The tilting of the tilting frame in the cart frame is accomplished by journal studs rigidly secured to the cart frame in such positions that the journal axis extends substantially through a zone in which the center of gravity of the material carrier is located. The tilting frame includes carrier arms secured to the journal studs whereby it becomes possible to tilt the material carrier by 90° out of its substantially horizontal orientation into a plane which is oriented substantially vertically. Thus, the material carrier in its horizontal position can easily be moved relative to a dyeing chamber having a substantially horizontal orientation. On the other hand, the material carrier in its vertical orientation can easily be lifted out of the tilting frame by means of an overhead lifting mechanism, for moving the material carrier into the drum of a centrifuge having a vertical structural orientation. The material carrier can be easily lowered into or lifted out of the drum by the vertical lifting mechanism. Similarly, once the dewatering in the centrifuge is completed, the material carrier can again be loaded onto the tilting mechanism, whereupon the tilting mechanism is again brought into its horizontal orientation for moving a material carrier into a dyeing chamber.

By arranging the journal studs in such a manner that the journal axis extends substantially through the center of gravity zone of the material carrier in its loaded condition, the forces needed for stabilizing the material carrier in its end positions are relatively small so that respective locking and latching members need to take up respectively small forces.

The tilting frame according to the invention is equipped with means for avoiding any unintended movement of the material carrier along the skids in any of its two possible positions. One end of the material carrier is restrained by a holding arm journalled on a central shaft which in turn is supported by transverse beams forming part of the tilting frame. The transverse beams interconnect the skids and the holding arm tiltably secured to the central shaft carries, preferably at its upper end, an engaging member for entering into an opening of the material carrier to hold the carrier on the skid rails. Preferably, the engaging member enters into a central opening of the material carrier, whereby such central opening is located in a circular base plate of the material carrier. The other end of the material carrier is restrained on the material skids by one, preferably two stop members, at least one of which is adjustable in its position relative to the carrier and skids. The engaging member which enters into a hole, preferably a central hole of the material carrier, holds the latter against displacement in one axial direction and against displacement in both circumferential directions while the above stop members hold the material carrier against displacement in the opposite axial direction. Thus, the holding arm with its engaging member holds the material carrier, especially when the skids are tilted out of the horizontal orientation into the vertical position.

Preferably, the cart frame is equipped with a bracket which supports the skids when the latter are tilted by 90° out of the vertical plane into the substantially horizontal orientation, whereby a locking member secures the tilting frame and thus the skids to the support bracket against an unintended or accidental tilting movement. The just described features have the advantage that the material carrier and the tilting frame are retained in the desired position at all times, whereby especially the skids are fixed in their horizontal position which they preferably take up during movement of the cart from one location to another.

The stop members which are preferably provided in pairs for each skid provide stop means for blocking the carrier rollers so that a relative movement of the material carrier on the skids is prevented. Preferably, at least one set of stop members is adjustable along the length of the skids. Thus, it is possible to first move the adjustable stop out of the way so that the material carrier may be moved sufficiently far to the right for bringing the holding arm and its engagement member into such a position that the engagement member can move into the opening of the material carrier when the latter is moved toward the holding arm. The adjustable stop member is then moved against the material carrier rollers at the end opposite to the holding arm, whereby the material carrier is securely held at both ends.

BRIEF DESCRIPTION OF THE DRAWINGS

In order that the invention may be clearly understood, it will now be described, by way of example, with reference to the accompanying drawings, wherein.

Figure 1:
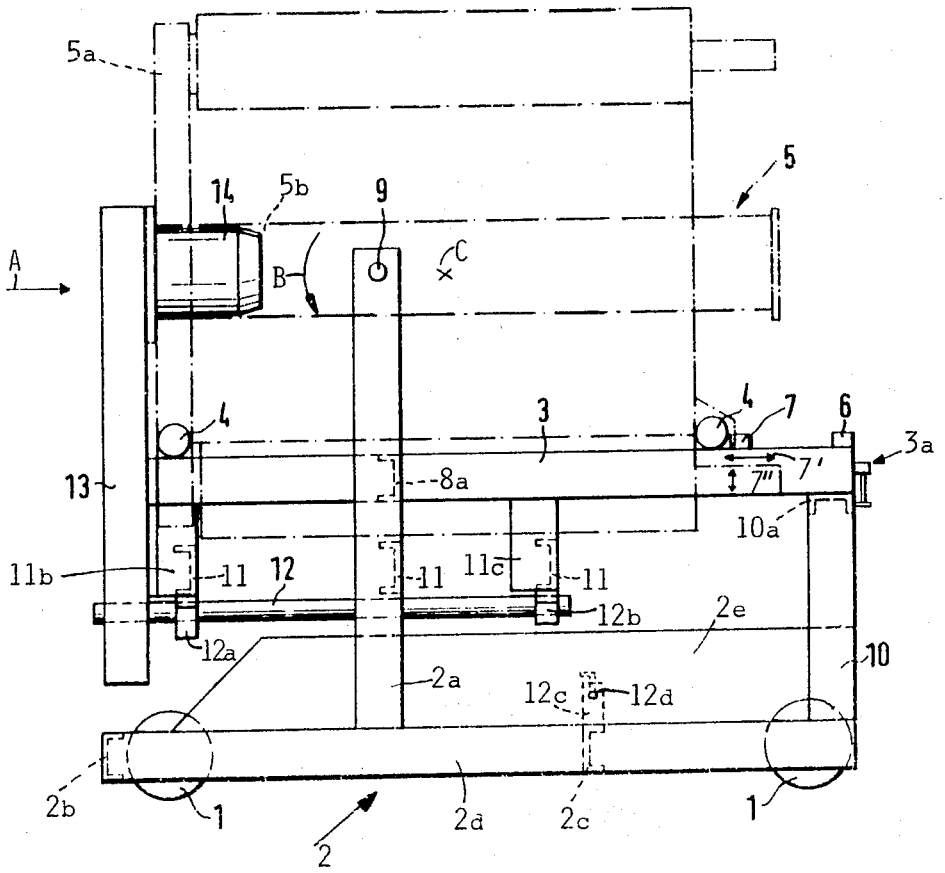
FIG. 1 is a side view of the present cart with a material carrier shown in its horizontal orientation by dash-dotted lines.

DETAILED DESCRIPTION OF PREFERRED EXAMPLE EMBODIMENTS AND OF THE BEST MODE OF THE INVENTION

The cart shown in the drawings comprises a cart frame structure 2 supported by cart wheels 1. A bottom frame section is formed by interconnecting, for example, by welding U-rail members **2*b*, 2*c*, and 2*d* together. Two upright posts 2*a* are secured to the bottom frame section and to reinforcing plate members 2*e* which in turn are secured to the longitudinal rails 2*d* and to two front bracket posts 10 which in turn are interconnected by a cross support beam 10*a***.

A tilting frame comprising primarily two parallel skids 3 and 3' carried by mounting arms 8 are journalled to the upright posts **2*a* by rigid journal studs 9. The skids 3 and 3' are connected to the arms 8 by cross members 8*a*. Additionally, the skids 3, 3' are connected through tilting frame members 11*a*, 11*b* and 11*c* to cross beams 11, whereby the tilting frame forms a cradle type support for a material carrier 5 equipped with rollers 4 riding or resting on the two parallel skids 3, 3'. The material carrier 5 also has a bottom plate 5*a* provided with an opening 5*b***, preferably extending coaxially with the central longitudinal axis of the material carrier.

Figure 2:
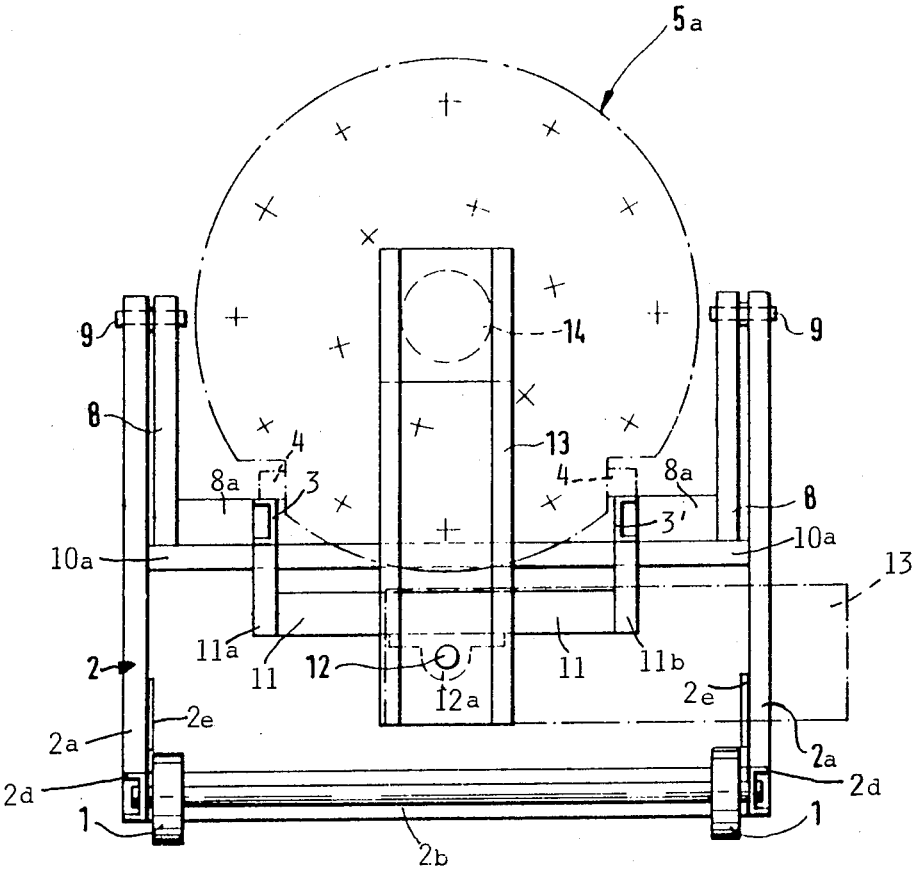
FIG. 2 is a rear view of the cart as viewed in the direction of the arrow A in FIG. 1.

A longitudinal shaft 12 is mounted to the cross beams 11, preferably centrally thereof, as best seen in FIG. 2. Two journal bearings **12*a* 12*b* hold the shaft 12 rotatably in place. The left-hand free end of the shaft 12 has rigidly secured thereto a holding arm 13 provided at its upper end with an engagement member 14 fitting into the opening 5*b* of the material carrier. It is also possible to rigidly secure the shaft 12 to the cross beams 11 and tiltably securing the holding arm 13 to the free end of the shaft 12. In any event, the holding arm can take up the two positions, one of which is shown by full lines in FIG. 2 and the other is shown by dash-dotted lines in FIG. 2. In the full line position, the arm 13 restrains the material carrier 5 from moving leftwardly as shown in FIG. 1. In the dash-dotted position the arm 13** permits the loading of the material carrier into the tilting frame.

The details of the material carrier 5 are not part of the invention. The right-hand end of the material carrier 5 is restrained by at least one stop member 6 at the right-hand end of the skids 3. Preferably, further stop members 7 are provided on top of the skids 3 for adjustment back and forth as indicated by the double arrow 7'. The stops 7 may also be adjustable in a direction crosswise to the length of the skids 3 as shown by the double arrow 7 for stopping the carrier. By making the stops 7 adjustable, it is possible to first move the material carrier 5 sufficiently to the right for bringing the arm 13 with its engagement member 14 into the holding position shown in full lines in FIG. 2. Thereafter, the material carrier is shifted to the left and when the engagement member 14 has fully entered into the opening **5*b*, the stops 7 are moved to the left so that the material carrier is restrained at both ends for transport. The adjustable stop 7** is provided with conventional means for rigidly securing its adjusted position to the tilting frame.

Figure 3:
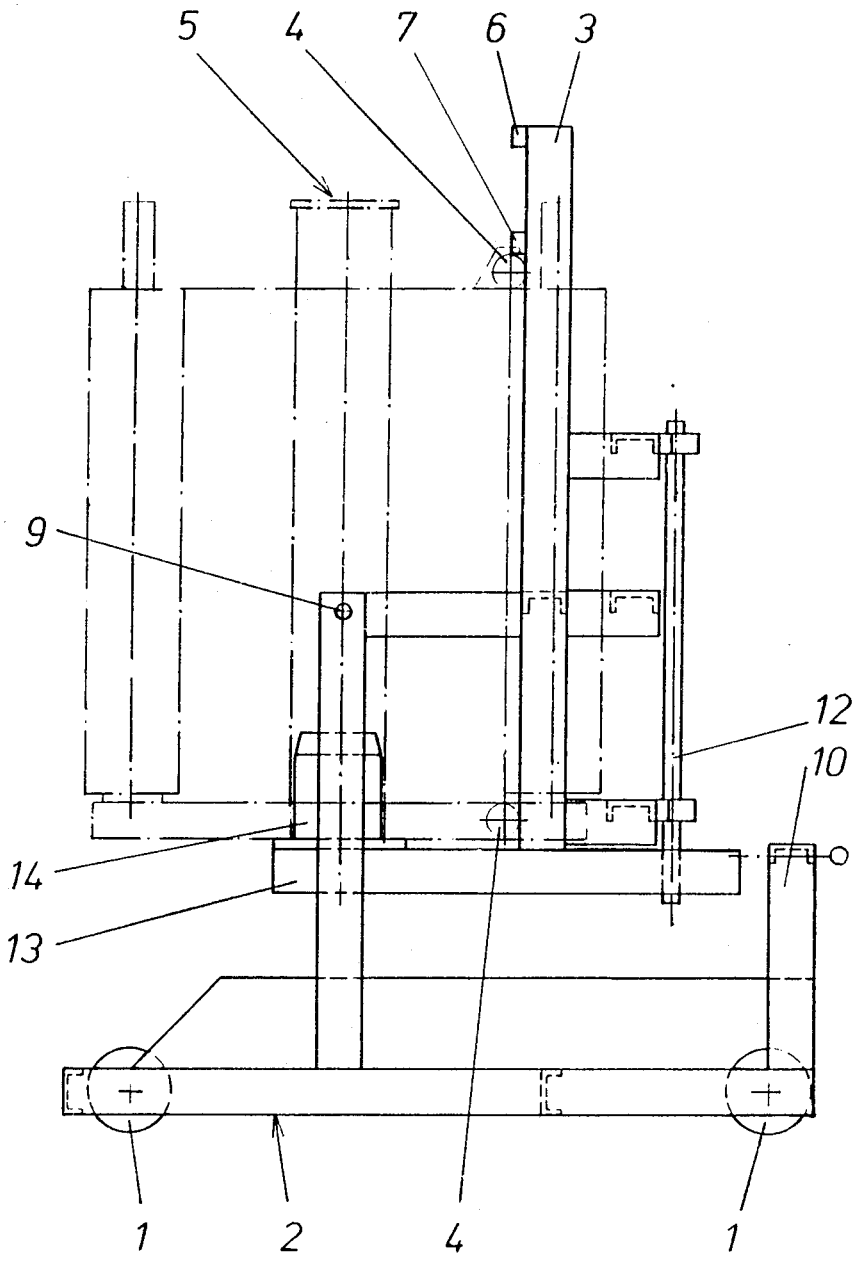
FIG. 3 is a view similar to that of FIG. 1, but showing the tilting frame in its vertical orientation as compared to the horizontal orientation shown in FIG. 1.

Incidentally, the upright posts **2*a* are of sufficient length to provide the clearance necessary for the lower left-hand end of the holding arm 13 when the entire tilting frame, including the holding arm 13, is tilted into the vertical position shown in FIG. 3. A stop 12*c* centrally secured to the cross beam 2*c* makes sure that the tilting frame cannot be tilted through an angular range larger than intended. The tilting direction into the vertical position is shown by the arrow B in FIG. 1. A locking mechanism 3*a* holds the tilting frame, or rather the right-hand free end of the skids 3, 3' in a locked position in which the skid end rests on the cross support 10*a*. Such locking mechanisms 3*a* are conventional. The stop 12*c* is also be provided with a conventional latch mechanism 12*d*** for holding the tilting frame securely in its vertical orientation.

As shown in FIG. 1, the upright posts **2*a* are so located, that the journal axis defined by the journal studs 9 extends through a zone in which the center of gravity C of the material carrier 5 is located. This journal axis does not extend exactly through the center of gravity so that the material carrier exerts a certain torque moment in a direction contrary to the arrow B, whereby the material carrier presses the right-hand free ends of the skids 3, 3' down onto the cross support 10*a* with a certain force. Thus, the locking mechanism 3*a*** is optional because the force exerted by the material carrier may be sufficient to maintain the tilting frame in its horizontal orientation.

For the above described loading operation in which the holding arm 13 is moved into the dash-dotted position shown in FIG. 2, the cart is backed against the door of a dyeing chamber and a material carrier 5 is slid onto the skids 3, 3'. During this operation, the cart may be locked to the dyeing chamber by conventional means not shown. The loading and securing then proceeds as described above. When the material carrier 5 is secured in its position with the holding arm 13 and the stop members 7 located in the positions shown in FIG. 1, the cart may be safely moved on its wheels 1 to any other location in which the material carrier 5 is then again turned into its vertical position with the holding arm 13 supporting the material carrier which then may be lifted out of the cradle after the stop members 7 has been moved away from their position shown in FIG. 1. The tilting operation may be performed by a conventional drive not shown. Similarly, the lifting and lowering operation of the carrier 5 is performed by conventional means not shown, for example, to move the entire material carrier into a centrifuge having a vertical central axis.

Although the invention has been described with reference to specific example embodiments, it will be appreciated, that it is intended to cover all modifications and equivalents within the scope of the appended claims.

What I claim is:

1. A cart for transporting a material carrier having rollers, comprising cart frame means, wheel means rotatably secured to said cart frame means for rolling said cart frame means along a floor, skid means for supporting said carrier rollers and said material carrier, tilting frame means for mounting said skid means, journal means (9) for tilting securing said skid mounting tilting frame means to said cart frame means, said journal means having a journal axis extending substantially through a zone in which the center of gravity of said material carrier is located, wherein said skid means comprise two parallel skid rails (3, 3'), and traverse means interconnecting said parallel skid rails, a shaft connected to and extending perpendicularly to said traverse means, an arm (13) journalled through said shaft to said traverse means for holding said material carrier, said arm further comprising an engaging member (14) secured to said arm for entering into an opening of said material carrier to hold said material carrier on said skid rails.

2. The cart of claim 1, further comprising bearing means **(12*a*, 12*b*)** for centrally securing said shaft to said traverse means for permitting tilting of said holding arm between a material carrier restraining position and a material carrier loading position.

3. The cart of claim 1, wherein said engaging member is a centering stud secured to an upper end of said holding arm for entering into a central opening of said material carrier.

4. The cart of claim 1, wherein said cart frame means comprise bracket means (10) arranged for supporting one end of said skid means when said skid means are tilted into a substantially horizontal position.

5. The cart of claim 4, further comprising locking means for locking said skid means to said bracket means when said skid means are in said substantially horizontal position.

6. The cart of claim 1, wherein said skid means comprise stop means for blocking said carrier rollers of a material carrier resting on said skid means, said stop means being adjustable relative to said skid means for permitting a temporary shifting of said material carrier along said skid means.

7. The cart of claim 6, wherein said stop means comprise two stopping members at least one of which is adjustable in its position along said skid means.

8. The cart of claim 1, further comprising abutment means in said cart frame means for holding said tilting frame means in an angular position relative to the horizontal.

9. The cart of claim 8, wherein said abutment means comprise latch means for preventing said tilting frame means from accidentally leaving said angular position.

* * * * *